US005400484A

United States Patent [19]

Gay

[11] Patent Number: 5,400,484

[45] Date of Patent: Mar. 28, 1995

[54] ADJUSTABLE ROLLER SKATE

[75] Inventor: Howard Gay, West Brookfield, Mass.

[73] Assignee: Hyde Athletic Industries, Inc., Peabody, Mass.

[21] Appl. No.: 965,733

[22] Filed: Oct. 23, 1992

[51] Int. Cl.[6] ..... A63C 17/00; A44B 11/00

[52] U.S. Cl. ..... 24/585; 24/68 J; 280/11.19

[58] Field of Search ..... 280/11.19, 11.26; 24/585, 584, 583, 68 J, 71 J, 70 J

[56] References Cited

U.S. PATENT DOCUMENTS

| | | | |
|---|---|---|---|
| Re. 32,346 | 2/1987 | Klamer et al. | 280/11.2 |
| 215,956 | 5/1979 | Miller . | |
| 1,483,853 | 2/1924 | Schwerd | 24/585 |
| 2,171,448 | 8/1939 | Holtz | 24/585 |
| 3,385,299 | 5/1968 | Le Roy | 24/585 |
| 4,334,690 | 6/1982 | Klamer et al. | 280/11.21 |
| 4,377,887 | 3/1983 | Valestin | 24/206 R |
| 4,553,767 | 11/1985 | Robjent et al. | 280/11.21 |
| 4,708,352 | 11/1987 | Vullierme | 280/11.26 |
| 4,932,676 | 6/1990 | Klamer | 280/11.2 |
| 4,976,017 | 12/1990 | Frano | 24/585 |
| 5,184,352 | 2/1993 | Maufette | 24/585 |

FOREIGN PATENT DOCUMENTS

| | | | |
|---|---|---|---|
| 0558614 | 9/1932 | Germany | 24/585 |

*Primary Examiner*—Richard M. Camby
*Attorney, Agent, or Firm*—Wolf, Greenfield & Sacks

[57] ABSTRACT

An adjustable roller skate having means to independently lock the front wheels against rearward movement and the rear wheels against any movement, means to selectively lengthen the roller skates to a variety of sizes, and means to securely lock a foot or leg strap in selected positions against accidental release.

1 Claim, 4 Drawing Sheets

ADJUSTABLE ROLLER SKATE

BACKGROUND OF THE INVENTION

1. Field of the Invention

This invention relates to a new and improved roller skate having a variety of adjustable components, in particular, front wheels which may be locked against rearward movement, rear wheels which may be locked against any movement, an extendible skate length, and an easily adjusted ankle strap.

2. Background

Roller skates have been in use for well over one hundred years and in that time many patents have been obtained for a variety of improvements on the basic arrangement of four wheels connected to a foot support. For example, U.S. Pat. No. 189,783 was issued Apr. 17, 1877. The patent relates to a method for mitigating rattling which resulted after extended use. Since that time, a wide variety of other patents have issued for improvements in the roller skate field.

Among the other improvements are means for preventing backward movement of a roller skate. A basic ratchet and pawl arrangement has been used for many years. A loosely pivoted pawl drawn downwardly by the force of gravity is disclosed in U.S. Pat. No. 2,896,833, issued Apr. 15, 1884. The skate also had an attachment for securing the pawl out of alignment with the ratchet portion when desired.

More recently, U.S. Pat. No. 4,553,767, issued Nov. 19, 1985, and U.S. Pat. No. 4,932,676, issued Jun. 12, 1990, demonstrate a more intricate internal mechanism for preventing backward movement of at least one wheel of a roller skate. Both designs, however, are susceptible to a variety of problems which may be encountered by the user. For example, the pawl in both arrangements extends out of the frame of the roller skate and below the plane defined by axles. The pawl engages a plurality of teeth located on an inner surface of the wheel formed by a coaxial channel with the riding surface of the wheel. This channel significantly reduces the strength of the wheel, making it more susceptible to deformation than if the wheel were solid or had an internal webbing. This deformation may prevent the pawl from engaging the teeth.

Another problem with the arrangements shown in the above-mentioned patents is that the pawl extends below the plane formed by the axles. The pawl is more susceptible to jamming in either the upward or downward position because of dirt, rocks, or mud than an arrangement wherein the pawl never extends below the plane. Furthermore, the pawl which is unprotected and exposed to the ground may be forced upward and be disengaged from the wheel when used on an uneven surface. This may result in injury to a child because the wheel may unexpectedly rotate.

Extendible roller skates have been used for years and patents have issued for such mechanisms. For example, U.S. Pat. No. 4,708,352, issued Nov. 24, 1987 describes the use of a dog positioned on the upper surface of the skate which may be lifted to release a tongue secured to one-half of the skate provided with teeth for engagement with complementary teeth on the other half of the skate.

It is essential that the elements do not flex too much since flexing may result in breaking or other problems from extended use. The tongue of the U.S. Pat. No. 4,708,352, for example, may lose its elasticity after a period of time in the locked in position without being released. Simplicity and reliability of design are also important for a beginner's skates.

Buckle designs for ankle straps have also been in existence for many years. Recently, U.S. Pat. No. 4,433,458, issued Feb. 28, 1984, demonstrates the use of a pawl member supported on one strap for engagement with teeth located on a second strap. By depressing the pawl, the position of the second strap may be adjusted.

As mentioned above, simplicity and reliability are essential characteristics of a child's skate product. A buckle arrangement which releases too easily has the potential for seriously harming the user. Thus, the buckle must be designed to retain a child's foot in the event of accidental touching or bumping of the pawl.

The characteristics of a suitable child's roller skate, or beginner's roller skate, requires a variety of adjusting mechanisms so that the user may "grow" with the same skates. It is important, especially for a child, to have a consistent roller skate to prevent any immediate or significant change in the skate to which he or she has become accustomed. Therefore, the skate must be adjustable according to the child's growth both physically and as a skater. Economically, it is also beneficial to have a sturdy adjustable skate which can be used by many members of a family.

SUMMARY OF THE INVENTION

The principal object of the present invention is to provide an improved roller skate which has an easily adjustable length, adjustable strap, and locking mechanism to secure front wheels from backward rotation and the rear wheels from any rotation at all.

Another object of the present invention is to provide a sturdy roller skate which can sustain constant banging and jarring commonly imparted by a young child.

It is still a further object of the present invention to provide a roller skate having substantially nondeformable wheels and means for maintaining a secure engagement of a wheel locking mechanism which extends from the main portion of the skate.

It is still a further object of the present invention to provide a wheel locking mechanism which is not susceptible to jarring or displacements by objects common to a riding surface.

It is still a further object of the present invention to provide a single means for adjusting the length of a roller skate which will not become deformed during use of the skate.

It is still a further object of the present invention to provide a buckle arrangement which is simple to use while also providing a secure lock against opening when accidentally bumped during use of the skate.

To accomplish these and other objects, the roller skate of the present invention comprises a foot fastening assembly, a length locking assembly, a rear wheel locking assembly, and a front wheel locking assembly against rearward movement of the wheels.

The foot fastener includes a buckle and a strap. The buckle has a pair of longitudinally spaced opening for receiving the strap. The strap a pair of serrated edges along its length which are selectively engaged within the buckle portion.

The length locking assembly comprises a plurality of traverse parallel slots disposed on one half of the skate. An arm is secured to the other half of the skate. The arm selectively interlock within the slots of the first skate to provide the means for adjustment.

The rear wheel locking assembly comprises an elongated metal bar secured to a finger actuated slide for movement to and from an interferring position between spaced teeth extending radially along the wheels. The bar is secured into the selected position by a mating means comprised of dimples along the slide and recess on the chassis which snap-locks the slide into position.

The front wheel locking assembly comprises a spline-like member having a plurality of radially extending spaced teeth extending inwardly from the wheels. A bar moves vertically in and out from between the grooves defined by the teeth corresponding to locked and unlocked positions. In the locked position, the bar inhibits rearward movement of the wheels while still allowing forward movement of the same wheels.

These and other objects and features of the present invention will be better understood and appreciated from the following detailed description of one basic embodiment thereof, selected for the purpose of illustration, and shown in the accompanying drawings in which:

DETAILED DESCRIPTION OF THE PREFERRED EMBODIMENT

Figure 1:
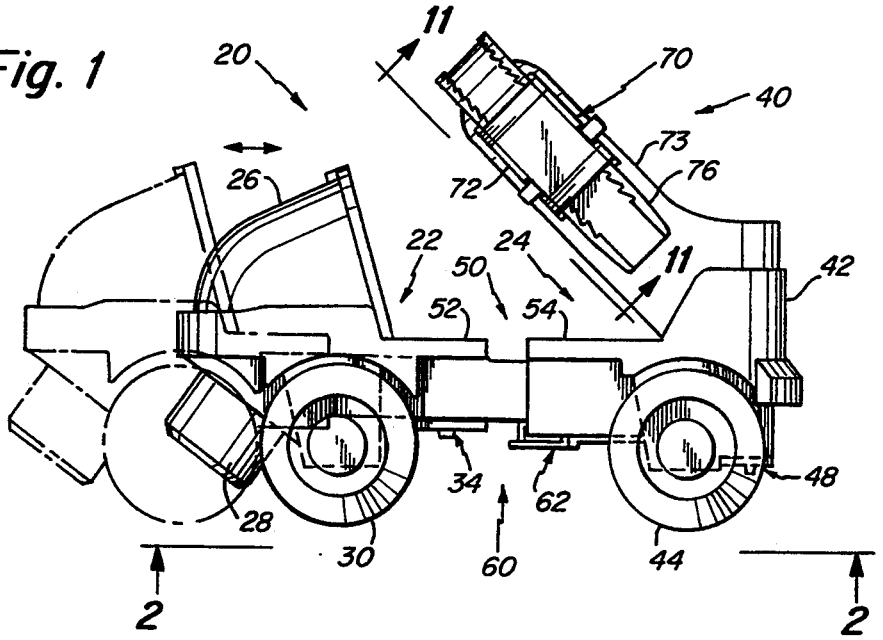
FIG. 1 is a side elevational view of the roller skate showing the roller skate in an extended position in phantom.
Figure 2:
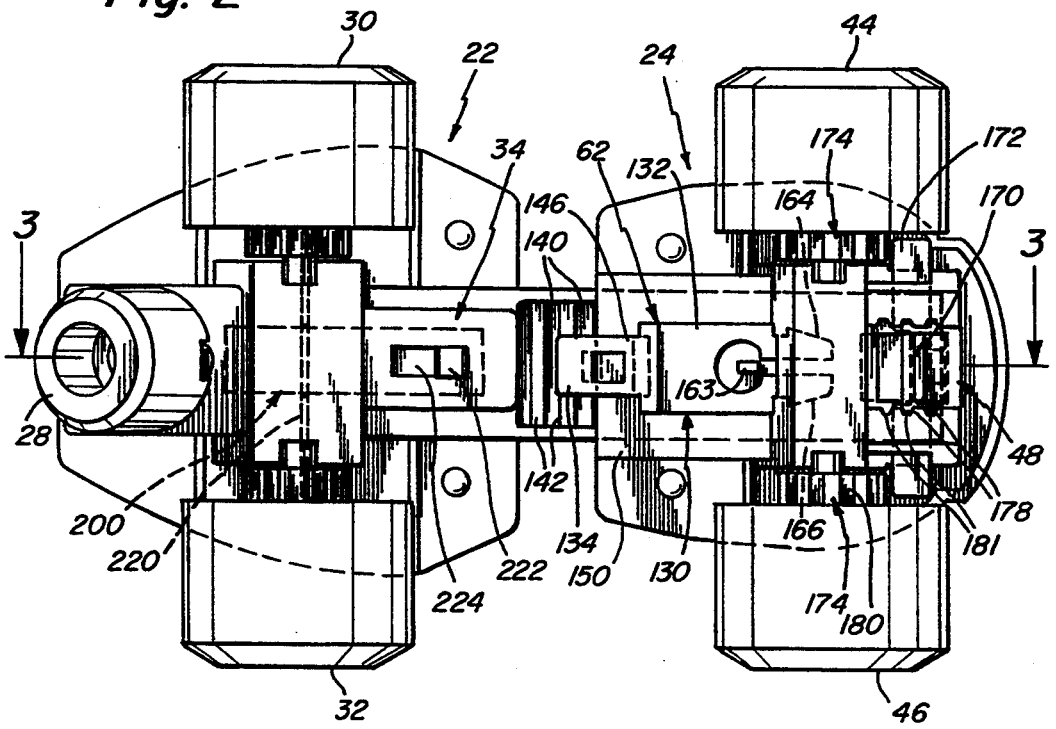
FIG. 2 is a bottom view of the roller skate as shown in FIG. 1.

The overall arrangement of the roller skate 20 and location of the various features may be best seen in FIGS. 1 and 2. The roller skate 20 comprises substantially two sections, a front section 22 and a rear section 24. The front section, as seen in FIG. 1, includes a toe cap 26, a toe stop 28, front wheels 30 and 32, and a front wheel lock assembly 34. The rear section 24 includes an ankle or foot fastener 40 which supports the buckle assembly 70, a heel cup 42, a pair of rear wheels 44 and 46, and a rear wheel locking assembly 48. Combined, the front section 22 and rear section 24 form a foot or shoe support surface 50 comprising a front support surface 52 and a rear support surface 54. On the underside 60 of the roller skate 20, opposite the foot or shoe support surface 50, is the length locking assembly 62 which is formed by elements located on both the front section 22 and the rear section 24.

Figure 11:
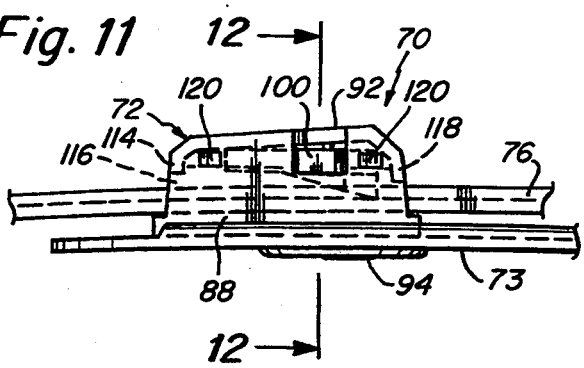
FIG. 11 is a detailed view of the buckle arrangement taken along the lines 11—11 of FIG. 1.

The buckle assembly 70 of the present invention may be best understood from FIGS. 1 and 11–14. The overall arrangement comprises a buckle housing 72 secured to a buckle support portion 73, a U-shaped pincer 74, and a strap 76 which passes through the buckle housing 72 in the secured arrangement (FIG. 11).

The strap 76 has an upper surface 78 (FIG. 14) along which a channel 80 extends. The channel 80 has forward straight edges 82 extending from the tip 84 of the strap 76. Extending rearwardly along the channel 80, the forward straight edges 82 are followed by serrated edges 85 which extend the remaining securing length of the strap 76. The thickness of the strap 76 (FIG. 11) may be tapered along the forward straight edges 82 for easier insertion into the buckle housing 72.

Figure 12:
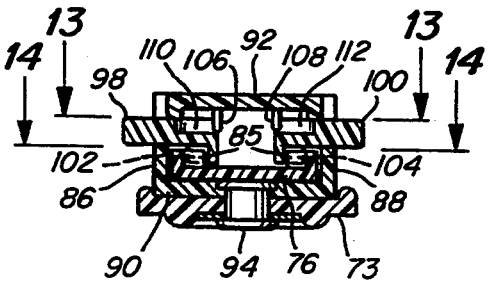
FIG. 12 is a cross-sectional view taken along the lines 12—12 of FIG. 11.

The buckle housing 72 comprises side walls 86 and 88, base 90, and cover 92. The base 90 is secured to the buckle support portion 73 of the ankle or foot fastener 40. A rivet 94 or other securing means may be used (FIG. 12).

Figure 13:
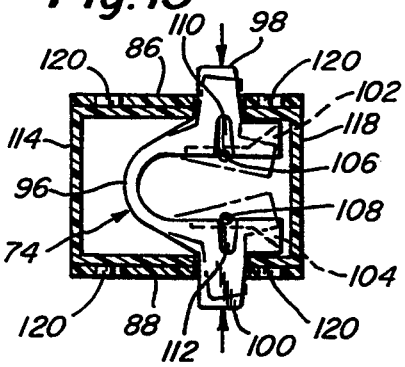
FIG. 13 is a cross-sectional view taken along the lines 13—13 in FIG. 12.
Figure 14:
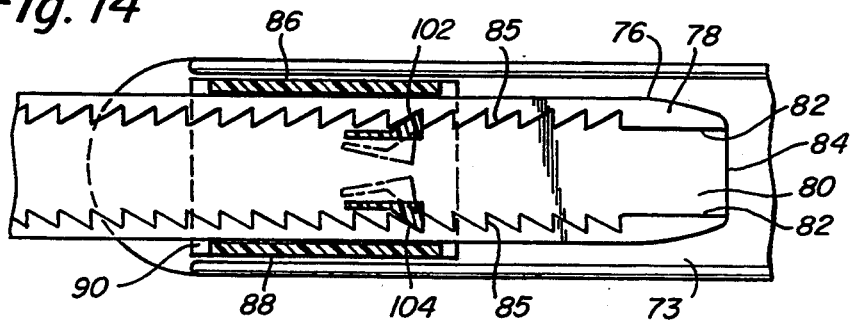
FIG. 14 is a cross-sectional view taken along the lines 14—14 in FIG. 12.

The pincer 74 may be best seen in FIG. 13. The pincer 74 comprises a bight or bend section 96, a pair of finger engagements 98 and 100, and a pair of strap engaging means 102 and 104. The pincer 74 is preferably U-shaped, however, V-shaped or some other configuration is possible. The pincer 74 is made of a hard material, preferably plastic, which permits bending along portion 96 upon an exertion of force at the finger engagements 98 and 100. For most effective operation, a simultaneous squeezing is required.

The lateral movement of the finger engagements 98 and 100 is limited by posts 106 and 108 which are secured to the cover 92. The posts 106 and 108 extend donwardly into recesses 110 and 112, respectively, thereby limiting inward horizontal movement of the pincer 74 as shown in phantom in FIG. 13. The finger engagements 98 and 100 further pass through the side walls 86 and 88 of the buckle housing 72. This arrangement limits both outward and inward horizontal motion of the pincer 74.

The strap 76 is guided by a forward portion 114 of the cover 92 into engagement with the strap engaging means 102 and 104 of the pincer 74. The forward portion 114 extends orthogonally toward the base 90 of the buckle housing 72. This arrangement limits the opening 116 through which the strap 76 is initially passed for securing. Similarly, the rearward portion 118 extends downwardly toward the base 90. This further helps guide the strap 76 within and through the buckle housing 72 as well as to help keep the strap 76 close to the buckle support portion 73. Finally, the cover securing means 120 may be seen along the side walls 86 and 88 which comprises holes in the side walls 86 and 88 through which protrusions in the cover 92 are secured for simple assembly.

While the overall roller skate 20 is preferably made from plastic, the type of plastic may vary for each element. For example, the wheels 30, 32, 44, and 46 should be made of strong, durable plastic, capable of withstanding forces both from the user and the riding surface. The wheels 30, 32, 44, and 46 should also be "gouge resistant" to maintain an even outer surface for smooth skating. On the other hand, the strap 76 should be soft and bendable to fit a variety of foot or leg sizes and shapes. The degree of stiffness of the plastic for each of the remaining elements should be self-evident. Clearly elements that must be bent or manipulated have to be softer than those elements which endure a greater degree of stress.

Figure 3:
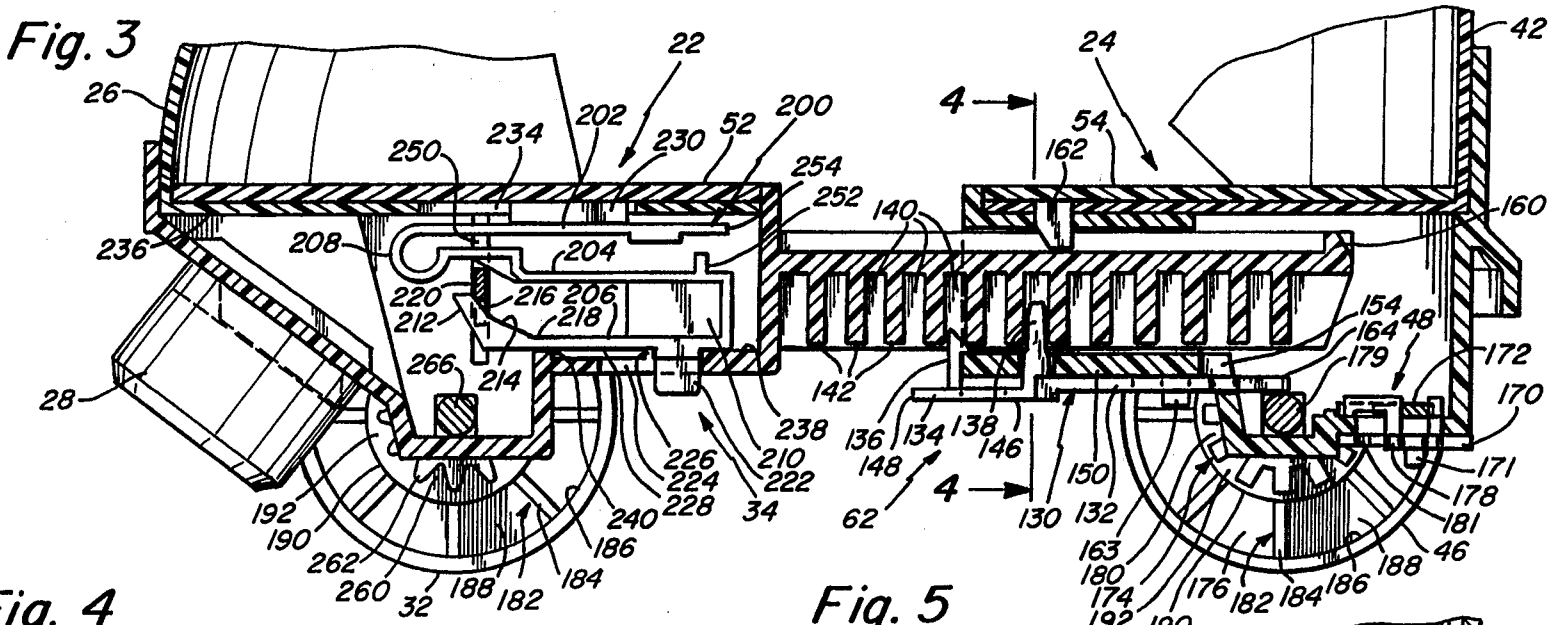
FIG. 3 is a cross-sectional view of the invention taken along the lines 3—3 in FIG. 2.
Figure 5:
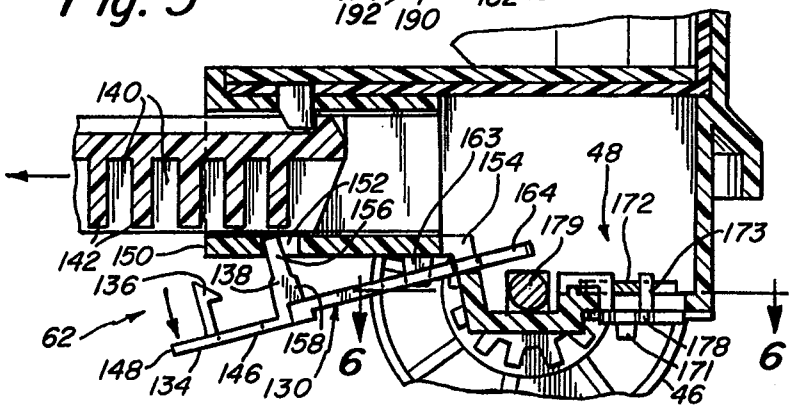
FIG. 5 is a fragmentary view of the rear section of the roller skate with the length locking assembly open for adjustment and the rear wheel locking assembly in the locked position.
Figure 4:
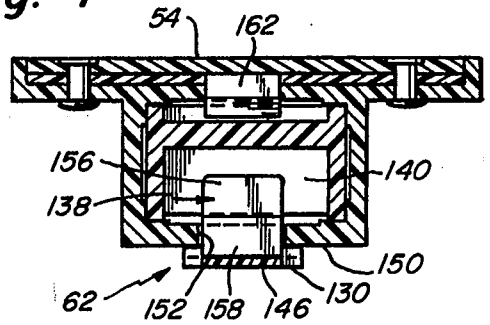
FIG. 4 is a cross-sectional view taken along the lines 4—4 in FIG. 3.

The length locking assembly 62 may be best seen in FIGS. 2–5. The length locking assembly 62 comprises a securing arm 130 having a body portion 132 with an offset head portion 134 at one end and with a pair of outwardly extending flanges or securing braces 164 and 166 formed at the other end (FIG. 2). The securing arm 130 is shaped and positioned to pivot to and from a locking position. The locked position is shown in FIG. 3. The unlocked position is shown in FIG. 5.

The rear end of the body portion 132 projects through an opening 154 in the chassis 150 and is secured in this pivoting location by the securing braces 164 and 166 which define opposed slots that loosely engage the wall of the chassis 150 as best shown in dotted outline in FIG. 2. A protrusion 163 extends downwardly from the chassis 150 of the rear section. The protrusion 163, as seen in FIG. 2, extends between braces 164 and 166 to prevent inward flexing which in turn retains the securing arm 130 within the opening 154 of the rear section 24. This arrangement prevents undesired displacement of the securing arm 130 by any accidental or incidental pressure along the sides of the body portion 132 near the securing braces 164 and 166.

The inner side of the securing arm 130, that is, the side facing the underside 60 of the skate 20, has a hook 136 and a main post 138 projecting upward (FIG. 5). Arranged in facing relation to the hook 136 and main post 138 are a plurality of parallel transverse slots 140 defined by flanges 142 extending downwardly from the front section 22. While the embodiment illustrated locates the securing arm 130 in the rear section 24 and the flanges 142 extend from the front section 22, the position of the securing arm 130 and the slot 140 may be interchanged. The length locking assembly 62 may be disposed along the upper surface of the roller skate 20 where the foot or shoe support surface 50 is presently located.

The securing arm 130 has a flexing region 146 along the head portion 134 proximate to the body portion 132. The securing arm 130 is released with a downward force exerted by finger pressure on the end 148 of the head portion 134. On this downward movement of the arm 130, the hook 136 and post 138 are released from engagement. The flexing region 146 is essential to the removal of the hook 136 from the secured position as seen in FIG. 5. The flexing region 146 bends to permit disengagement of the hook 136 from the chassis 150 of the rear section 24. Similarly, the flexing region 146 bends in the same direction when pushing the head portion 134 into engagement with the chassis 150.

The main post 138 passes through an opening 152, located on the underside 60 of the chassis 150, when the securing arm 130 is in a locked position (FIG. 3). The main post 138 has a top section 156 and a bottom section 158. The top section 156 has a width substantially similar to the width of the slots 140. The bottom section 158 has a width similar to the opening 152. This arrangement further secures the securing arm 130 in the locked position as shown in FIG. 3.

Flange 160 is positioned to abut stopper 162 which limits the extension of the roller skate 20. The flange 160 extends upwardly from the front section 22 into and is permanently housed within the rear section 24. The stopper 162 projects downwardly and is secured within the chassis 150 on the rear section 24. FIG. 3 illustrated the skate in a short configuration while FIG. 5 illustrates the skate in its longest position.

The rear wheel locking assembly 48 may be best seen in FIGS. 1–3, 5, and 6. The rear wheel locking assembly 48 includes an elongated metal securing bar 72 (FIGS. 5 and 6) located within the chassis 150 and rearward of the axle 179. The bar 172 is positioned to slide parallel to its length forwardly and rearwardly and is secured to the top of a finger actuated slide 170 which, in turn, is supported for forward and rearward sliding movement by the inner sides of the chassis 150. The finger actuated slide includes a downwardly projecting U-shaped section 173 terminating in a finger grip 171. The ends of the bar 172 project outwardly from the chassis 150. These ends are adapted to move into interferring engagement with gear-like protrusions 174 extending from the inner sides 176 of the rear wheels when the bar 172 is moved forwardly on forward movement of the grip 171.

Figure 6:
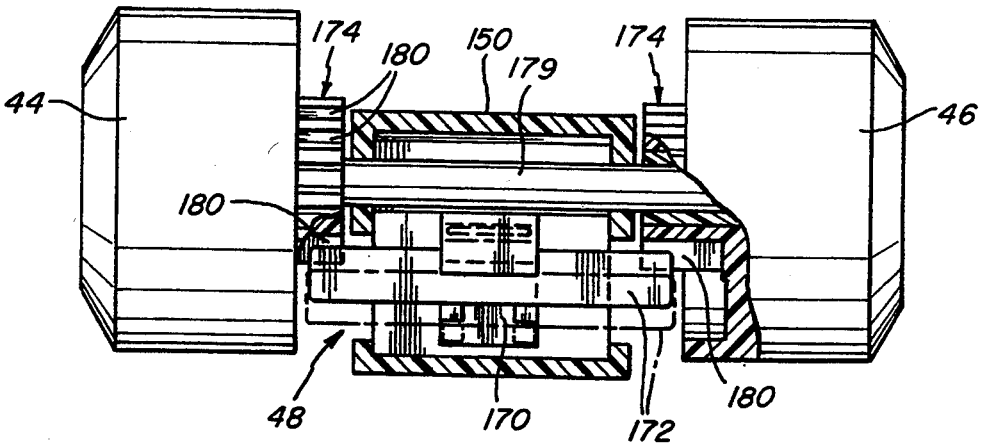
FIG. 6 is a cross-sectional view taken along the lines 6—6 in FIG. 5.

The bar 172 may assume two positions, the first away from the protrusions 174, as shown in phantom in FIG. 6, or within the wells 180 defined by the protrusions 174.

A means for securing the bar 172 in either position, includes a plurality of dimples 178 shaped to mate with a plurality of similarly sized recesses 181. In the present embodiment, the recesses 181 are located on the chassis 150 and the dimples 178 are arranged on the sides of the finger actuated slide 170 in facing alignment to the recesses 181. This arrangement creates a snap sound when the finger actuated slide 170 is slid from one position to another, further helping the user identify when the bar 172 is secured in the locked or unlocked position.

The securing means for the finger actuated slide 170 substantially limits the likelihood that objects commonly found on the riding surface may jar the slide 170 into the position other than the one in which it was set. The arrangement as described requires a measurable force that a very young child is unlikely to have. Thus, a parent may set the rear wheels 44 and 46 in a locked position with little concern that the child will be able to release the bar 172 from the locked position.

Both the front and rear wheels 30, 32, 44, and 46 are similarly designed (FIG. 3). Each wheel 30, 32, 44 and 46 has an internal webbing 182 formed by internal panels or webs 184 which extend between outside wall or rim 186 and side wall 188 within the wheels 30, 32, 44, and 46 and a centered core 190. Protrusions 174 and teeth 262 in turn extend from the outer surface 192 of the core 190. This arrangement provides strength through use of the internal webbing 182 as well as means to not require a pawl member to extend below the axle plane.

The front wheel lock assembly 34 may be best seen in FIGS. 3 and 7–10. The assembly 34 includes a substantially S-shaped main element 200 having a top level 202, a middle level 204 and a bottom level 206. A spring segment 208 is formed in the element 200 between the top level 202 and the middle level 204. A reinforcement panel 210 extends between the middle level 204 and the bottom level 206. The rear end 212 of the main element 200 is shaped to form a ramp 214 having a peak 216 and a base 218. The ramp 214 is shaped and positioned to move a bar 220 into and out of operative engagement with the front wheels 30 and 32 as discussed more fully below.

Figure 7:
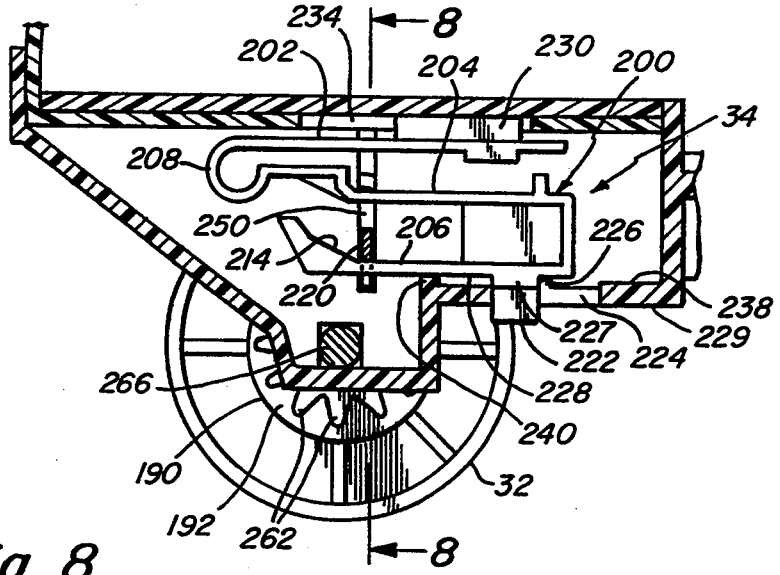
FIG. 7 is an enlarged fragmentary view of the front wheel locking assembly of the invention showing the lock in the on position.
Figure 8:
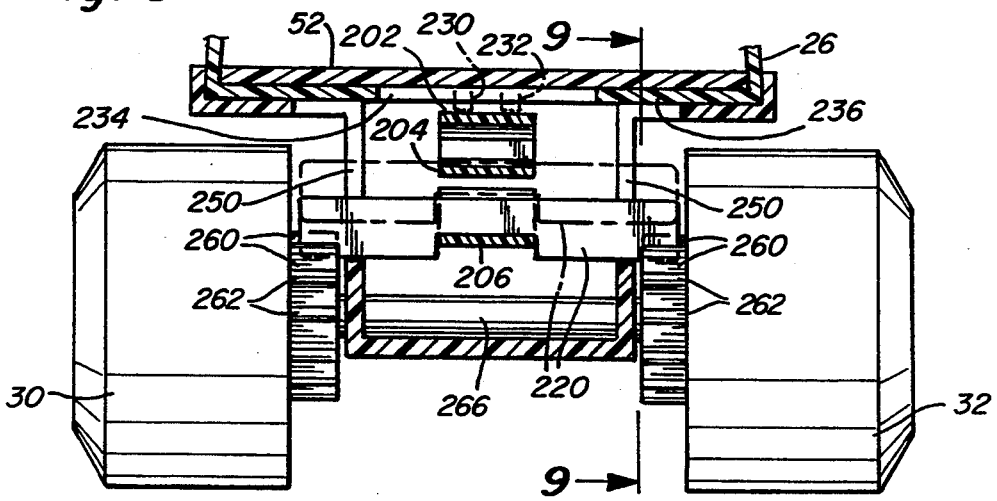
FIG. 8 is a cross-sectional view taken along the lines 8—8 in FIG. 7.

A finger engagement button 222 extends downwardly from the bottom level 206 of the main element 200 and out through an opening 224 of the underside 60 of the roller skate 20. The button 222 forms a shoulder 227 at its upper end with the lower surface 228 of the bottom level 206 as best illustrated in FIG. 7. A pair of upwardly extending protrusions 226 formed at the side edges of opening 224 of the skate body 229 normally engage the main element 200 and restrict its horizontal movement. The main element 200 may be moved by pushing the finger engagement button 222 slightly upward so that the shoulder 227 may clear the protrusion 226. However, the required upward motion is so minimal that virtually any nonhorizontal movement imparted on the finger engagement button 222 will allow the shoulder 227 to clear the protrusion 226. It appears to the user that the finger engagement button 222 is being moved horizontally, when, in fact, there is a slight upward direction.

In the normal vertical positioning of the main element 200, the top level 202 urges against a pair of flanges 230 and 232 (FIG. 8) which extend downwardly from the front support surface 52 of the front section 22. The flanges 230 and 232 also extend through an opening 234 in the toe cap plate 236 which secures the toe cap 26 below the front support surface 52. The bottom level 206 of the main element 200 is urged against platforms 238 and 240 (FIG. 7) as well as protrusions 226. Platform 238 is only engaged when the front wheel locking assembly 34 is in the "on" position as seen in FIG. 7. FIGS. 3 and 7 show the front wheel lock assembly 34 in the "off" position and "on" position respectively.

In the "off" position (FIG. 3), the bottom level 206 of the main element 200 rests against platforms 238 and 240 as well as protrusions 226. Simultaneously, the bar 220 is at the peak 216 of the ramp 214. In the "on" position, as seen in FIG. 7, the platform 238 does not support the main element 200. Furthermore, the bar 220 rests at the base 218 of the ramp 214. This arrangement provides two secure positions for the bar 220 while protecting the main element 200 from lateral movement. The bar 220 moves vertically within slots 250 in response to its position relative to the ramp 214.

When changing the position of the front wheel lock assembly 34, the user engages button 222 and shifts the main element 200 either to or from the "on" or "off" position as desired. As mentioned above, a slight vertical motion must be imparted on the finger engagement button 222 to permit the shoulder 227 to clear the protrusions 226. The engagement exerts an upward force on the bottom level 206, and the middle level 204 which are secured in parallel by reinforcement panel 210. The middle level 204 and bottom level 206 move angularly toward top level 202 when the force exerted on the finger engagement button 222 bends the main element 200 at the spring segment 208. The middle level 204 has a stop 252 projecting upwardly from the level 204 to engage the free end 254 of the top level 202 which prevents the finger engagement button 222 from being accidentally pushed into the body 229.

Figure 9:
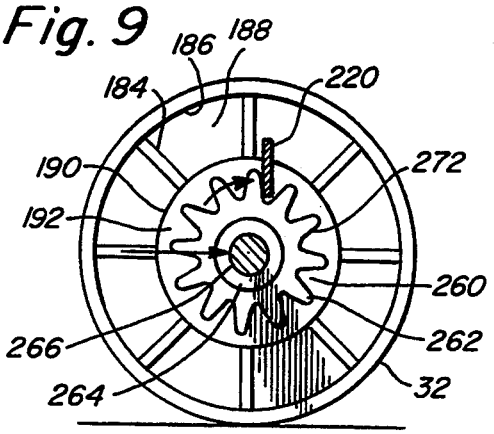
FIG. 9 is cross-sectional view taken along the lines 9—9 in FIG. 8 with a rearward force imparted on the roller skate.
Figure 10:
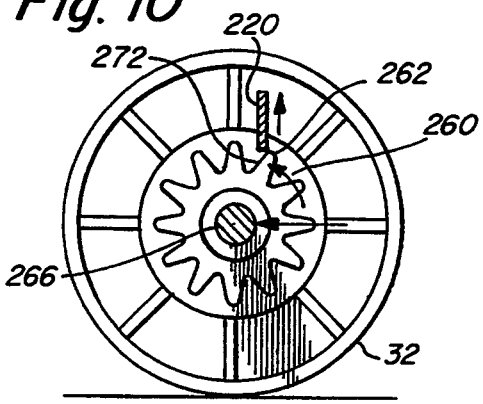
FIG. 10 is the same view as FIG. 9 except with a forward force imparted on the roller skate.

The positions of bar 220 relative to the wheels 30 and 32 in the on and off positions are shown in FIGS. 9 and 10. FIGS. 7 and 9 show the bar 220 in the on position wherein the bar 220 is at the base 218 of the ramp 214. The bar 220 in the on position (FIG. 9) engages a spline-like member having recesses 260, defined by teeth 262. This spline-like member is coaxially and integrally formed on the core 190 which in turn is integral to the wheel 30 or 32. The spline-like member surrounds a plastic bearing 264 which further engages an axle 266 connecting both wheels 30 and 32 to one another.

The bar 220 lies in a plane parallel and off-center to a plane extending through the center of the axle 266. As shown in FIG. 9, the bar 220 is to the right of the center. Thus, when the wheel 30 or 32 is moved backward as shown by the horizontal force arrow passing through the center of the wheel 30 or 32, a side 272 of the tooth 262 engages the bar 220 squarely so that the bar 220 is not raised out of position. If, on the other hand, the wheel 30 or 32 moves in a forward direction opposite that shown in FIG. 9 (FIG. 10), then the bar 220 is engaged by a tooth 262 at its bottom edge and raised upward along the side 272 of a tooth 262 and over the tooth 262 into the next recess 260, thus permitting forward movement of the skate 20 while inhibiting rearward movement. When the bar 220 is at the peak 216 of the ramp 214, the bar 220 does not engage or touch the teeth 262 of the wheel 30 or 32.

Various changes and modifications and equivalents of the embodiment described above and shown in the drawings may be made within the scope of this invention. For example, the invention includes simply switching the front and rear wheel locking assemblies. Also, one may position the length locking assembly on the top foot support surface of the skate. Thus, it is intended that all matters contained in the above description or shown in the accompanying drawings are presented by way of example only and are intended to be interpreted in an illustrative and not limiting sense.

What is claimed is:

1. A buckle and strap securing arrangement, comprising:

a buckle housing have a pair of longitudinally spaced openings of substantially similar size;

a strap having a pair of serrated edges along its length extending through said opening; and means within said buckle housing for selectively engaging said serrated edges of said strap;

said means for selectively engaging comprising a separable U-shaped pincer having a pair of coplanar ends shaped to mate with said serrated edges;

said strap has said serrated edges spaced inwardly from the outer edges of said strap with said serrated edges defining a space therebetween into which said coplanar ends project; and said buckle housing has a pair of internal posts and wherein said pincer has a pair of recesses shaped to receive said posts, forming means to guide and retain said pincer in position with said housing.

* * * * *